United States Patent [19]

Brown

[11] Patent Number: 4,828,638

[45] Date of Patent: May 9, 1989

[54] THERMOGRAPHIC TRANSFER ELEMENTS AND METHODS

[75] Inventor: Albert E. Brown, Locust Valley, N.Y.

[73] Assignee: Chemicraft International, Inc., New York, N.Y.

[21] Appl. No.: 65,787

[22] Filed: Jun. 24, 1987

[51] Int. Cl.[4] ..... B41M 5/26

[52] U.S. Cl. ..... 156/234; 156/240; 427/265; 428/195; 428/212; 428/216; 428/336; 428/484; 428/488.4; 428/520; 428/522; 428/913; 428/914

[58] Field of Search ..... 428/195, 207, 211, 484, 428/488.1, 488.4, 522, 913, 914, 212–216, 336, 520; 400/120, 241.1; 156/230, 234, 239, 240; 427/256, 261, 26 J

[56] References Cited

U.S. PATENT DOCUMENTS

| | | | |
|---|---|---|---|
| 4,581,266 | 4/1986 | Magnotta | 428/488.4 |
| 4,585,688 | 4/1986 | Nakamura et al. | 428/209 |
| 4,623,580 | 11/1986 | Koshizuka et al. | 428/207 |
| 4,681,796 | 7/1987 | Maehashi et al. | 428/218 |
| 4,774,128 | 9/1988 | Koshizuka et al. | 428/195 |

FOREIGN PATENT DOCUMENTS

| | | | |
|---|---|---|---|
| 224392 | 12/1984 | Japan | 428/488.4 |
| 1179787 | 8/1986 | Japan | 428/488.1 |

*Primary Examiner*—Ellis P. Robinson
*Assistant Examiner*—P. R. Schwartz
*Attorney, Agent, or Firm*—Perman & Green

[57] ABSTRACT

Transfer sheets and ribbons having a thin foundation carrying two superposed heat-transferable coatings. The base coating is cohesive, nonadhesive, substantially colorless and free of coloring matter and oil, and functions as a heat sink to insulate the top layer against excessive melting. The supercoating is more adhesive than the base coating, contains coloring matter and has excellent bonding properties for the base layer and also for receptive sheets including those having very smooth or glossy surfaces and relatively smooth closely-woven fabrics.

Heat-transferred images are strongly adhered to the receptive sheet and produce no visible loss of clarity or sharpness if smudged by contact since the portion of the images exposed to contact is free of coloring matter.

16 Claims, No Drawings

THERMOGRAPHIC TRANSFER ELEMENTS AND METHODS

The present invention relates to the production of improved thermographic transfer elements which overcome the problem of loss of sharpness or clarity of the images formed thereby as a result of smudging or smearing during contact with the hands and/or with automatic reading devices.

Transfer elements, such as sheets and ribbons, commonly have a film foundation and one or more colored coatings which transfer to a copy sheet in heated areas of the transfer element. Commonly, heating is accomplished by means of a heated stylus or thermal head applied adjacent the rear surface of the foundation while the colored coating is in contact with a copy sheet, to melt and transfer corresponding heated areas of the coating and cause them to transfer to the copy sheet or other receptive surface such as relatively smooth fabrics such as closely woven cloth. Commonly, the copy sheet is a product label having a smooth, glossy surface and the heat-transferred images comprise automatically-readable product information, such as a scannable bar code. Frequently the images transferred to a smooth, glossy copy sheet surface flow or spread to some small extent, which can prevent them from being read accurately by automatic scanning equipment.

The receptive surface may also be a closely-woven fabric such as a natural or synthetic cloth label for clothing to which information such as laundering instructions is heat-transferred. Such information, comprising wash-resistant images, must be resistant to smudging and stain-transfer to other fabric portions under the effects of rubbing and agitation, such as occurs in a washing machine and/or dryer.

While the commercially-available thermographic transfer elements generally are capable of producing heat-transferred images of good sharpness and clarity, particularly on rough copy paper stock and woven fabrics, such images are susceptible to smudging during handling and/or under the effect of rubbing contact, such as with the automatic reading or scanning equipment or in a washing machine and/or dryer, resulting in smudged images which cannot be accurately read automatically or visually.

Attempts to overcome these problems by formulating he heat-transferable imaging layer so as to be harder and more smear-resistant have not been satisfactory. Harder transfer layers are more resistant to rapid softening and more strongly bonded to the foundation thereby resulting in copy images which are partial or spotty and which cannot be read accurately or sensed reliably.

Reference is made to U.S. Pat. No. 4,627,997 for its disclosure of thermal transfer sheets which may have two colored heat-transferable imaging layers. References is also made to U.S. Pat. No. 4,623,580 for its disclosure of thermal transfer sheets which may have two colored heat-transferable imaging layers. References is also made to U.S. Pat. No. 4,623,580 for its disclosure of thermal transfer sheets which have a supercoating, which may be free of coloring matter, over a colored base layer.

SUMMARY OF THE INVENTION

The present invention is based upon the discovery that novel thermographic transfer elements can be produced, which provide clean, sharp and clear copy images which retain these properties during handling and abrasion, by providing such transfer elements with a colorless, meltable, heat sink undercoating which transfers with the colored imaging layer to completely envelop the imagewise colored imaging layer and shield it from contact with the hands, other garments, sensing equipment, etc. Thus, even if the colorless undercoating, which becomes a colorless supercoating over the formed images, is smudged on the copy sheet, such smudging is colorless and imperceptible to the eye and/or to the automatic reading or sensing equipment and does not alter the original sharpness or clarity of the images or their ability to be reliably read visually or by automatic scanning equipment.

The present transfer elements comprise a thin flexible foundation, preferably a plastic film foundation having a high degree of heat-resistance, such as polyethylene terephthalate polyester, a colorless viscous-cohesive, meltable wax undercoating which functions as a heat-conductive heat sink layer, and a colored, meltable wax imaging layer over the undercoating and having adhesive properties therefor and also for a copy sheet. Under the effects of heating, such as by contact of the rear of the film foundation with a heated stylus head or type face, the imagewise strong heat pattern is conducted by the colorless undercoating to the colored imaging layer to melt corresponding areas thereof to a highly viscous, flow-resistant state for fusion with the contacting surface of a receptive sheet. The contact between the heated stylus, head or type face and the rear surface of the film, although brief, causes the film to be heated to a greater degree that the transfer layers and, therefore, lubricant coatings are generally applied to the rear surface of the film foundation to prevent sticking and other problems. However, the present invention reduces this problem by interposing a colorless, meltable heat sink undercoating between the film and the main imaging layer, the heat sink layer conducting heat from the film through its thickness, in order to reduce the temperature of the heated areas of the film, and also insulating the imaging layer from the heated film.

Thermal transmission is the passage of heat through a body as the result of the combined effects of conductivity, convection and radiation, and a body resists becoming excessively heated when it transmits heat to an adjacent body or heat sink which effectively dissipates the heat. Applicant has discovered that a colorless wax undercoating functions as a heat sink for the present plastic film foundations by conducting heat from the film to the main imaging layer without absorbing the heat radiation. Thus, the undercoating remains cooler than if it contained infrared radiation-absorbing coloring matter, and it more effectively conducts heat away from the film foundation. Moreover, some of the conducted heat is used to melt the undercoating in the imagewise heat pattern areas so that the colorless undercoating transfers with the main imaging layer to form a colorless wax coating over the colored portions of the images on the copy sheet or receptive fabric. Thus, any smudging of the images during handling or processing of the heat-imaged copy sheet or fabric is not visible to the eye, or to automatic sensing equipment, since the smudged portion of the images comprises colorless wax.

The novel thermal transfer elements of the present invention comprise a thin substrate such as plastic film having a thickness of up to about 0.5 mil (0.0005 inch)

supporting two superposed heat-transferable layers, each having a thickness from about ¼ up to about 1.5 points (0.000025 to 0.00015 inch). The base layer or undercoating adjacent the film foundation, is substantially colorless, preferably free of oily materials which are flowable at ambient temperatures, and has a melting temperature which is higher than that of the top layer or colored imaging layer.

The colored imaging layer comprises a mixture of heat-meltable binder materials, primarily waxes, and one or more colorants which, in the case of washable fabrics, are insoluble in water or dry cleaning solvents.. It has a lower melting temperature than that of the undercoating, preferably is substantially free of oily materials which are flowable at ambient temperatures, and melts to a highly viscous, flow-resistant condition.

Under the effects of an applied imagewise heat pattern, the higher-melting undercoating provides a heat sink as it is melted while the colored top layer merely becomes softened and rendered viscous and adhesive in the heated areas, which areas bond to the contacting surface of the receptive sheet rather than liquifying and flowing thereover. The melted areas of the base coating release from the film foundation and transfer with the colored imaging layer to the receptive sheet to provide clear-supercoated images which are resistant to visible smudging or smearing as a result of handling, automatic scanning, washing abrasion, etc.

The present undercoatings may be applied to the substrate as hot melt compositions, or as solutions or dispersions in volatile solvents or vehicles. Since it is difficult to apply a thin layer of uniform thickness by hot melt means it is preferred to coat the present undercoatings from solutions and dispersions. However, this is not essential.

The preferred undercoat compositions comprise a major amount by weight of a wax binder material having a melting temperature between 190° F. and 215° F. and a minor amount by weight of a wax-like synthetic resin binder material having a higher melting temperature between 200° F. and 230° F. However, it is possible to use compositions, particularly those applied from solution or dispersion, in which the binder material consists solely of the synthetic resin binder having the indicated melting temperature.

A preferred wax binder material is a higher melting paraffin wax, with a melting temperature of about 200° F. However, other waxes of similar melting points are also suitable, including microcrystalline wax, spermaceti wax, beeswax, ceresine wax, and the like. Such waxes preferably comprise from about 55% by weight up to about 90% by weight of the total binder material of the undercoating.

Preferred synthetic resin binder materials having melting points between about 200° F. and 230° F. are the wax-like polyolefin homopolymers and copolymers such as low molecular weight polyethylene polymers and ethylene-vinyl acetate copolymers, polyethylene oxide polymers, polyethylene glycol polymers, acrylic polymers, and the like. Many of these polymers are available as meltable solids as well as solutions and dispersions or emulsions in volatile solvents or vehicles, including water.

The present undercoating compositions are free of coloring matter, such as pigments or dyes, but may contain up to about 20% by weight of non-melting, colorless lubricant materials such as polymer spheres or materials which "bloom", such as stearic acid.

The following examples illustrate suitable examples of hot melt undercoating compositions.

EXAMPLE 1

| Ingredients | Parts by Weight |
|---|---|
| Ethylene-vinylacetate polymer (Exxon EX042) | 33.3 |
| Paraffin wax - M.Pt.200° F. (Ross 100) | 66.6 |

EXAMPLE 2

| | |
|---|---|
| Ethylene-vinyl acetate polymer (DuPont EVA 210) | 20.0 |
| Paraffin wax - M.Pt.200° F. (Ross 100) | 80.0 |

EXAMPLE 3

| | |
|---|---|
| Ethylene-vinylacetate polymer (DuPont EVA 210) | 30.0 |
| Paraffin wax - M.Pt.200° F. (Ross 100) | 60.0 |
| Polytetrafluoroethylene polymer spheres (Fluorochem FS10) | 10.0 |

The present colored imaging layers comprise a major amount by weight of a lower melting wax binder material having a melting point within the range of from about 140° F. to about 180° F., such as a lower melting point paraffin wax, beeswax, ceresin wax, polyethylene wax, carbowax, etc, and contain from about 10% to about 25% by weight of coloring matter, preferably carbon black pigment.

In addition, the imaging layer composition can contain minor amounts by weight of other waxes, such as carnauba wax, in order to improve the coatability of the composition as a hot melt composition. Small amounts of synthetic resin binders may also be included, such as any of the low melting point resin binders mentioned as suitable for use in the undercoating composition, wetting agents, viscosity stabilizers, etc. The essential requirements are that the imaging layer has a lower melting temperature than the undercoating and that it is free of oily materials and soluble dyes which can leach into the copy sheet or fabric to reduce the sharpness and clarity of the images formed thereon.

As with the present undercoatings, the present colored imaging layers can also be applied in the form of hot melt compositions or as solutions or dispersions containing volatile solvents or vehicles, including water. The following example illustrates a suitable imaging layer composition, applied from hot melt:

EXAMPLE 4

| Ingredients | Parts by weight |
|---|---|
| Paraffin wax - M.Pt165° F. (Ross 165) | 55.5 |
| Carnauba wax - M.Pt. - 185° F. | 17.5 |
| Carbon black pigment | 17.0 |
| Ethylene-vinyl acetate polymer (DuPont EVA 210) | 4.0 |
| Wetting agent | 1.0 |

-continued

| Ingredients | Parts by weight |
|---|---|
| Viscosity stabilizer | 5.0 |

The foregoing undercoating layer and imaging layer are preferably applied as uniformly-thin layers, each having a thickness of from about $\frac{1}{4}$ to $\frac{3}{4}$ point so that the combined thickness is from about 0.5 point up to about 1.5 point. The thin supercoating improves the ability of the combined layers to transfer sharply to a copy sheet under the effects of a heated stylss applied against the rear uncoated surface of the film foundation to produce sharp images not only on rough paper but also on smooth, glossy papers, by keeping the imaging layer, which is less exposed to the imaging heat, in a viscous state, lessening the flow experienced with lower viscosity ink layers which are in direct contact with the heated foundation.

Thus, the images formed on the receptive sheet are substantially sharper and clearer than those produced from identical transfer sheets and ribbons which do not include the undercoating. Moreover, the images produced by the present thermal sheets and ribbons are exceptionally resistant to visible smearing during handling, agitation and automatic scanning of the imaged receptive sheet, such as bar codes, codes on checks, mail and other copies which are intended for automatic scanning, such as by optical, magnetic, fluorescent or other means, and laundering instructions or other information applied to fabric labels which are intended for laundering in a washing machine or dry cleaning establishment. Such uses require that the images have perfect sharpness and clarity. Otherwise the printed copies are useless for their intended purposes.

Based upon the foregoing description of the invention it can be seen that illustrative embodiments of the invention have been disclosed and that modification of these embodiments may occur to those skilled in the art. Therefore, these illustrative embodiments are in no way meant or intended to limit the scope of the invention to these embodiments. The scope of the invention is instead meant to be limited only as defined by the appended claims.

What is claimed is:

1. A thermographic transfer element comprising a thin flexible foundation having on one surface thereof a substantially colorless, heat-meltable, heat-transferable undercoating having a thickness between about 0.000025 and 0.00015 inch, said undercoating having a melting temperature between about 190° and 230° F., and having on the surface of said undercoating a heat-meltable heat-transferable, colored imaging layer having a thickness between about 0.000025 and 0.00015 inch, said imaging layer comprising a major amount by weight of a heat meltable wax binder material and a minor amount by weight of coloring mater, and having a melting temperature which is lower than that of the undercoating and is within the range of from about 140° to about 180° F. said undercoating and imaging layer being meltable and heat transferable in image form in response to imagewise heating applied through the flexible foundation, to form images comprising a base of said colored imaging layer and a protective covering of said colorless undercoating which shields the colored imaging layer against smearing contact.

2. A transfer element according to claim 1 in which said undercoating comprises a major amount by weight of a wax and a minor amount by weight of a wax-like heat-meltable synthetic resin.

3. A transfer element according to claim 2 in which said wax comprises paraffin wax having a melting point between about 190° F. and 215° F.

4. A transfer element according to claim 2 in which said wax-like synthetic resin comprises an ethylene-vinyl acetate polymer.

5. A transfer element according to claim 1 in which said imaging layer comprises a major amount by weight of a wax binder material and a minor amount by weight of a wax-like heat-meltable synthetic resin binder material.

6. A transfer element according to claim 5 in which said wax compises a paraffin wax having a melting point between about 140° F. and 180° F.

7. A transfer element according to claim 5 in which said wax-like synthetic resin comprises an ethylene-vinyl acetate polymer.

8. A transfer element according to claim 1 in which said undercoating is substantially free of oily materials.

9. A transfer element according to claim 1 in which said imaging layer is substantially free of oily materials.

10. In the thermographic method for imagewise transferring portions of a meltable colored imaging layer comprising wax binder material and coloring matter from a flexible foundation to a receptive sheet under the effects of imagewise heat applied to the rear surface of the foundation, the improvement which comprises providing a substantially colorless, heat-transferable meltable heat sink layer between the foundation and the imaging layer to insulate the imaging layer against excessive melting, whereby the heated portions of the imaging layer become viscous and adhere and transfer to the receptive sheet surface in the form of sharp, clear images and the corresponding heated portions of the colorless heat sink layer transfer imagewise as clear colorless, protective supercoatings over said sharp, clear images.

11. A method according to claim 10 in which said heat sink layer has a thickness between about 0.000025 and 0.00015 inch, a melting temperature between about 190° F. and 230° F., and said heat-meltable imaging layer has a thickness between about 0.000025 and 0.00015 inch, and a melting temperature which is lower than that of the heat sink layer and is within the range of about 140° F. to about 180° F.

12. A method according to claim 10 in which said heat sink layer comprises a major amount by weight of a wax and a minor amount by weight of a wax-like heat-meltable synthetic resin.

13. A method according to claim 12 in which said wax comprises paraffin wax having a melting point between about 190° F. and 215° F.

14. A method according to claim 12 in which said wax-like synthetic resin comprises an ethylenevinyl acetate polymer.

15. A method according to claim 10 in which said imaging layer comprises a major amount by weight of a wax binder material and a minor amount by weight of a wax-like heat-meltable synthetic resin binder material.

16. A method according to claim 15 in which said wax comprises a paraffin wax having a melting point between about 140° F. and 180° F.

* * * * *